US008864533B2

(12) United States Patent
Morikawa

(10) Patent No.: US 8,864,533 B2
(45) Date of Patent: Oct. 21, 2014

(54) CONNECTOR HAVING A FLUIDPROOF MEMBER

(75) Inventor: Satoshi Morikawa, Yokkaichi (JP)

(73) Assignee: Sumitomo Wiring Systems Ltd., Yokkaichi (JP)

( * ) Notice: Subject to any disclaimer, the term of this patent is extended or adjusted under 35 U.S.C. 154(b) by 92 days.

(21) Appl. No.: 13/609,312

(22) Filed: Sep. 11, 2012

(65) Prior Publication Data

US 2013/0072060 A1 Mar. 21, 2013

(30) Foreign Application Priority Data

Sep. 20, 2011 (JP) ..... 2011-204810

(51) Int. Cl.

| | |
|---|---|
| ***H01R 4/18*** | (2006.01) |
| ***H01R 4/70*** | (2006.01) |
| ***H01R 43/00*** | (2006.01) |
| ***H01R 13/11*** | (2006.01) |
| ***H01R 4/62*** | (2006.01) |
| *H01R 13/52* | (2006.01) |

(52) U.S. Cl.

CPC ..... *H01R 13/11* (2013.01); *H01R 2201/26* (2013.01); *H01R 4/70* (2013.01); *H01R 43/005* (2013.01); *H01R 13/5216* (2013.01); *H01R 4/62* (2013.01); *H01R 13/521* (2013.01); *H01R 4/185* (2013.01)

USPC ..... 439/730; 439/595

(58) Field of Classification Search

CPC ..... H01R 4/20; H01R 13/5208; H01R 4/185

USPC ..... 439/730, 932, 587, 595, 732, 877

See application file for complete search history.

(56) References Cited

U.S. PATENT DOCUMENTS

| | | | | |
|---|---|---|---|---|
| 5,118,313 | A * | 6/1992 | Delalle | 439/730 |
| 5,795,170 | A * | 8/1998 | Okabe | 439/252 |
| 6,613,263 | B2 * | 9/2003 | Kondo | 264/263 |
| 6,824,428 | B2 | 11/2004 | Tabata et al. | |
| 7,063,567 | B2 * | 6/2006 | Ishikawa | 439/595 |
| 7,690,954 | B2 * | 4/2010 | Watanabe et al. | 439/730 |
| 8,360,803 | B2 * | 1/2013 | Sakai | 439/523 |
| 2010/0035485 | A1 * | 2/2010 | Okamura et al. | 439/877 |
| 2010/0144217 | A1 * | 6/2010 | Kumakura et al. | 439/877 |
| 2013/0072061 | A1 * | 3/2013 | Morikawa | 439/587 |

FOREIGN PATENT DOCUMENTS

| | | |
|---|---|---|
| JP | 2009230998 | 10/2009 |
| WO | 2012017744 | 2/2012 |
| WO | 2012081552 | 6/2012 |

* cited by examiner

*Primary Examiner* — Hae Moon Hyeon

(74) *Attorney, Agent, or Firm* — Gerald E. Hespos; Michael J. Porco; Matthew T. Hespos

(57) ABSTRACT

A housing (10) includes a cavity (11) into which a terminal fitting (40) fixed to an end portion of a wire (30) is to be inserted from behind. The terminal fitting (40) includes a barrel (42) to be fixed to a core (31) of the wire (30) and a contact part between the barrel portion (42) and the core (31) of the wire (30) is covered by a waterproof member (50). Recesses (23) that widen the width of the cavity (11) are formed in parts of peripheral walls (16) of the cavity (11) corresponding to the barrel (42) of the terminal fitting (40).

14 Claims, 7 Drawing Sheets

CONNECTOR HAVING A FLUIDPROOF MEMBER

BACKGROUND OF THE INVENTION

1. Field of the Invention

The invention relates to a connector.

2. Description of the Related Art

U.S. Pat. No. 6,824,428 discloses a conventional connector formed such that a terminal fitting fixed to an end portion of a wire is held in a housing by being inserted from behind into a cavity formed in the housing.

Aluminum cores have been used increasingly in recent years instead of conventional copper alloy cores for weight saving of automotive vehicles. On the other hand, terminal fittings made of copper alloy are used as terminal fittings in many cases to ensure sufficient strength when crimped and connected to cores of wires.

A core of a wire and a terminal fitting that are made of different metals form ions in the presence of moisture and generate electrolytic corrosion that progresses by electrochemical reaction in a connected part between the different metals.

Resin sealing a connected part between a core of a wire and a terminal fitting can prevent the presence of moisture and hence can prevent the occurrence of electrolytic corrosion. However, a terminal fitting with the above-described anti-corrosion measure has a part to be connected to a wire that is larger than conventional terminal fittings. Thus, in a connector compatible with a conventional terminal fitting, there is a problem that a clearance of a cavity becomes insufficient and a resin-sealed part contacts the peripheral wall of the cavity to make the insertion of the terminal fitting difficult.

Accordingly, for a connector compatible with a terminal fitting provided with an anti-corrosion measure, it is thought to widen a cavity in conformity with the size of the terminal fitting. However, such widening of the cavity enlarges the connector. Mounting space for a larger connector may not be in a vehicle. Thinning the peripheral wall of cavity could widen the cavity without enlarging the connector. However, the thinning of the peripheral wall of the cavity may lead to a short circuit between terminal fittings and a deteriorated resin flow in molding a housing.

The invention was completed in view of the above situation and an object thereof is to allow a terminal fitting provided with an anti-corrosion measure to be inserted and to prevent a short circuit between terminal fittings and a deteriorated resin flow in molding a housing without being made larger than conventional connectors.

SUMMARY OF THE INVENTION

The invention relates to a connector with a housing that has at least one cavity and at least one terminal fitting that can be inserted into the cavity. The terminal fitting includes a wire connection portion or barrel to be fixed to a core of a wire. A contact part between the wire connection portion and the core of the wire is covered by a fluidproof member. At least one recess is formed in a part of a peripheral wall of the cavity substantially corresponding to the wire connection portion of the terminal fitting and widens the width of the cavity.

Thus, a clearance is provided to allow insertion of the part of the terminal fitting that is slightly larger than a conventional size due to the presence of the fluid- or waterproof member on the terminal fitting with an anti-corrosion measure. Further, the cavity is widened by forming the recess in the peripheral wall of the cavity so that the connector is not widened. Furthermore, the recess is formed only in the part of the peripheral wall of the cavity corresponding to the barrel of the terminal fitting. Thus, a short circuit between terminal fittings and deteriorated resin fluidity in molding the housing caused by the thinned peripheral wall of the cavity is prevented.

The recess may include at least one inclined surface substantially in conformity with the outer shape of the fluid- or waterproof member. Accordingly, the size of the recess can be suppressed to a minimum necessary level.

The fluid- or waterproof member may comprise a heat shrinking tube.

The terminal fitting may include a connecting portion to be connected to a mating terminal fitting and a link joining the wire barrel and the connecting portion.

The fluid- or waterproof member may also cover an outer side of the link.

The link may include a fluid- or waterproof portion for at least partly filling a clearance between the link and the fluid- or waterproof member, and the recess may be formed in a part corresponding to the fluid- or waterproof portion.

The link may comprise a base plate and two side plates. The fluidproof portion at least partly fills up a groove enclosed by the base plate and the side plates.

The wire barrel preferably surrounds at least part of the core of the wire from an outer side and engages the core while the barrel pieces are crimped substantially into a heart shape with projecting edges of the barrel pieces butted against each other.

The barrel may be bent so that an insulation barrel projects out and a base plate of the barrel may be bent between the insulation barrel and the wire barrel to such an extent that upper ends of the insulation barrel and the fluidproof portion are at substantially the same height.

A vertical dimension of the recess may be substantially constant in its entirety and an end surface of a side plate of the link may be located substantially in the center of the recess in the vertical direction.

A part of a base wall of the cavity substantially corresponding to an insulation barrel of the wire connection portion may be formed with at least one escaping portion for increasing the width of the cavity in vertical direction. The escaping portion may be located outside of the insulation barrel and prevents the insulation barrel from hindering the insertion of the terminal fitting by contacting a wall of the cavity.

At least one support may project in at a front end position of the cavity for supporting a front end of a connecting portion of the terminal fitting and for restricting inclination of the terminal fitting in a resilient deforming direction of a locking lance. The support may be connected to both a front wall of the cavity and a side wall of the cavity.

At least one inclined surface may be provided on an end of the recess to conform to an outer shape of fluidproof member mounted on the terminal fitting. A part of the inclined surface may be oblique so that a distance therebetween gradually increases toward the inside of the cavity.

A depth of the recess may be reduced gradually toward the back and a front part of the recess may be inclined for gradually reducing the depth toward the front.

These and other objects, features and advantages of the invention will become more apparent upon reading of the following detailed description of preferred embodiments and accompanying drawings.

DETAILED DESCRIPTION OF THE PREFERRED EMBODIMENTS

Figure 1:
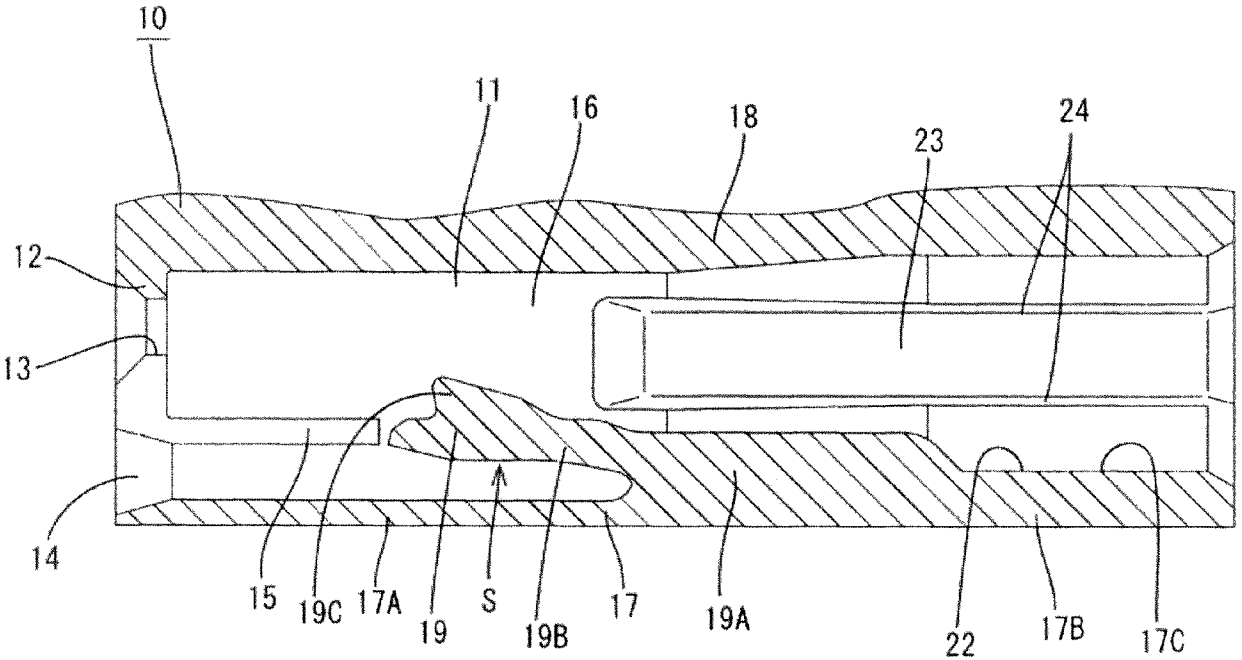
FIG. 1 is an enlarged side view partly in section of a housing of a connector according to the present invention showing the shape of a cavity.

A female connector in accordance with the invention is identified by the letter C and has a housing 10 and cavities 11 formed in the housing 10. Female terminal fittings 40 fixed to ends of respective wires 30 are to be inserted from behind into the cavities 11 in the housing 10. The terminal fittings 40 are electrically conductively connectable to male terminal fittings held in an unillustrated mating connector to be connected to the housing 10. An inserting direction of the terminal fittings 40 into the housing 10 is referred to herein as a forward direction, and upper and lower sides of FIG. 1 are referred to as the top and bottom.

The wire 30 having a core 31 formed by twisting a plurality of thin metal wires made of aluminum or aluminum alloy and an insulation coating 32 made e.g. of synthetic resin covers the outer periphery of the core 31. The insulation coating 32 is stripped over a specified length at the end of the wire 30 to expose the core 31 (see FIGS. 4 and 5). Note that the core 31 may be a single core wire.

The terminal fitting 40 includes a connecting portion 41 to be connected to an unillustrated mating terminal fitting, a barrel 42 to be connected to an end of the wire 30, and a link 43 linking the wire barrel 42 and the connecting portion 41. The terminal fitting 40 is formed by press-working a conductive plate material, such as copper or copper alloy, shaped to be long and narrow in forward and backward directions, and an unillustrated plating layer may be formed on the surface of the metal plate material. Tin, nickel or other metal as needed can be adopted as the plating layer. In this embodiment, a tin plating layer is formed on the surface of copper or copper alloy. Note that the plating layer may not be formed on the surface of the metal plate material.

The connecting portion 41 is a substantially rectangular tube and a tab of the mating male terminal fitting is to be inserted therein for connection. A base plate 44 extends in forward and backward directions behind the connecting portion 41 and the end portion of the wire 30 can be placed on the upper surface of the base plate 44.

The link 43 has two side plates 45 standing up from opposite lateral sides of the base plate 44 to define a U-shaped cross-section. The front and rear ends of the side plates 45 are continuous extensions of the connecting portion 41 and the wire barrel 42.

Figure 6:
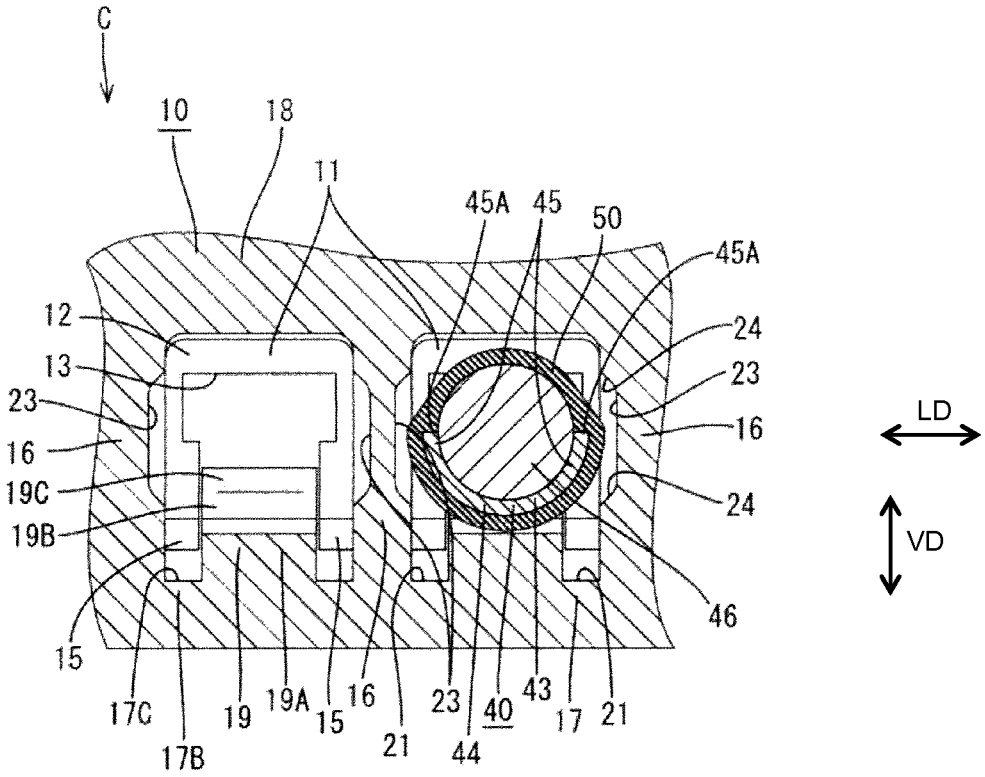
FIG. 6 is a partial enlarged lateral section along A-A of FIG. 4 of the connector showing the state where the terminal fitting is accommodated in the cavity.

The link 43 is provided with a fluid- or waterproof portion 46 for filling a groove enclosed by the base plate 44 and the side plates 45 without leaving any substantial clearance (see FIG. 6). The waterproof portion 46 is formed by fitting a resin processed material into the link 43 and applying a curing or heating treatment so that the waterproof portion 46 projects up or out from end surfaces 45A of the side plates 45.

The barrel 42 has an insulation barrel 42B to be crimped, folded or deformed into connection with an end of the insulation coating 32 and a wire barrel 42A to be crimped, folded or deformed into connection with the end of the core 31.

The wire barrel 42A initially is an open barrel with barrel pieces projecting from opposite lateral sides of the arcuate bottom plate 44 while substantially facing each other. The wire barrel 42A embraces or surrounds the core 31 from an outer side and bites into the core 31 while projecting edges of the barrel pieces are butted against each other to define a substantially heart shape. At least one (unillustrated) serration is formed on the inner surface of the wire barrel 42A.

The insulation barrel 42B also is likewise in the form of an open barrel with barrel pieces projecting from opposite lateral sides of the base plate 44 while substantially facing each other. The insulation barrel 42B is crimped, folded or deformed and connected while at least partly embracing the end of the insulation coating 32. The base plate 44 of the insulation barrel 42B is slightly larger than the bottom-base plate 44 of the wire barrel 42A and the barrel pieces of the insulation barrel 42B are narrower and longer in height than those of the wire barrel 42A.

Figure 4:
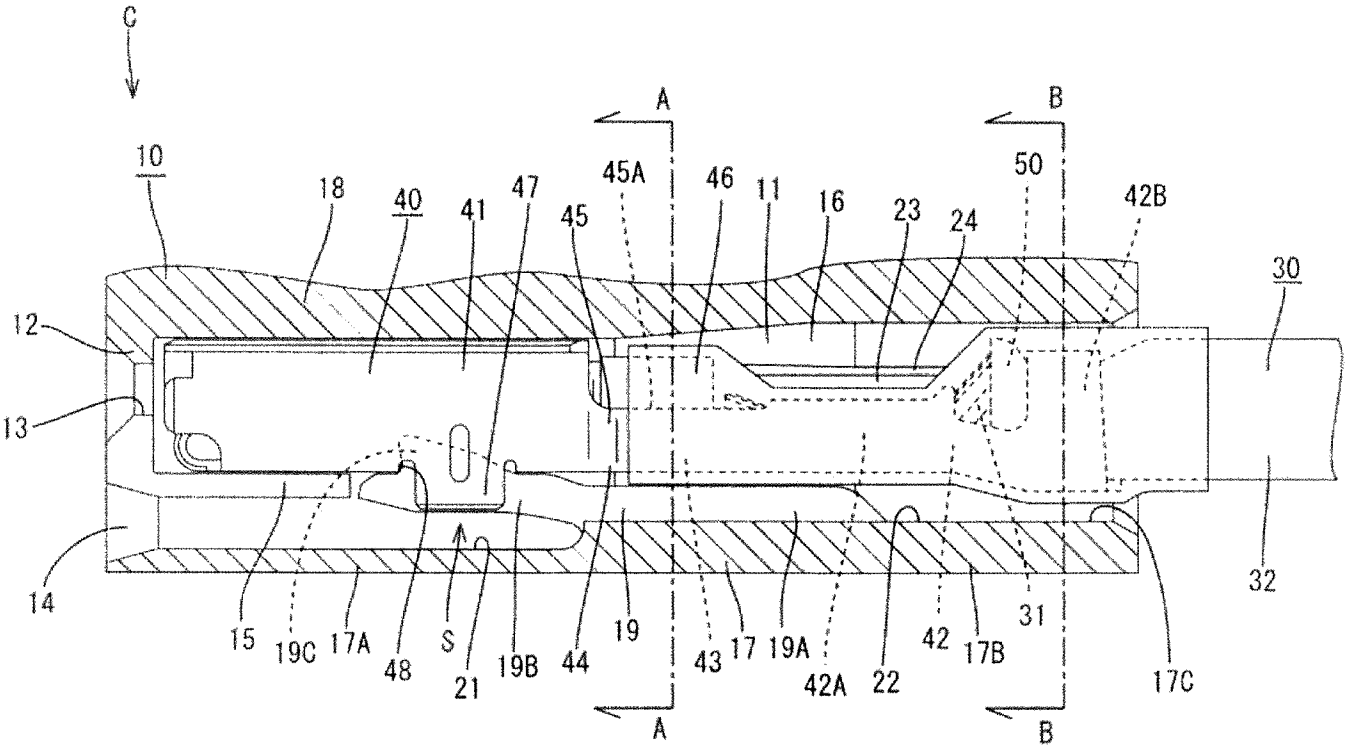
FIG. 4 is an enlarged side view partly in section of the connector showing a state where a terminal fitting is accommodated in the cavity.
Figure 5:
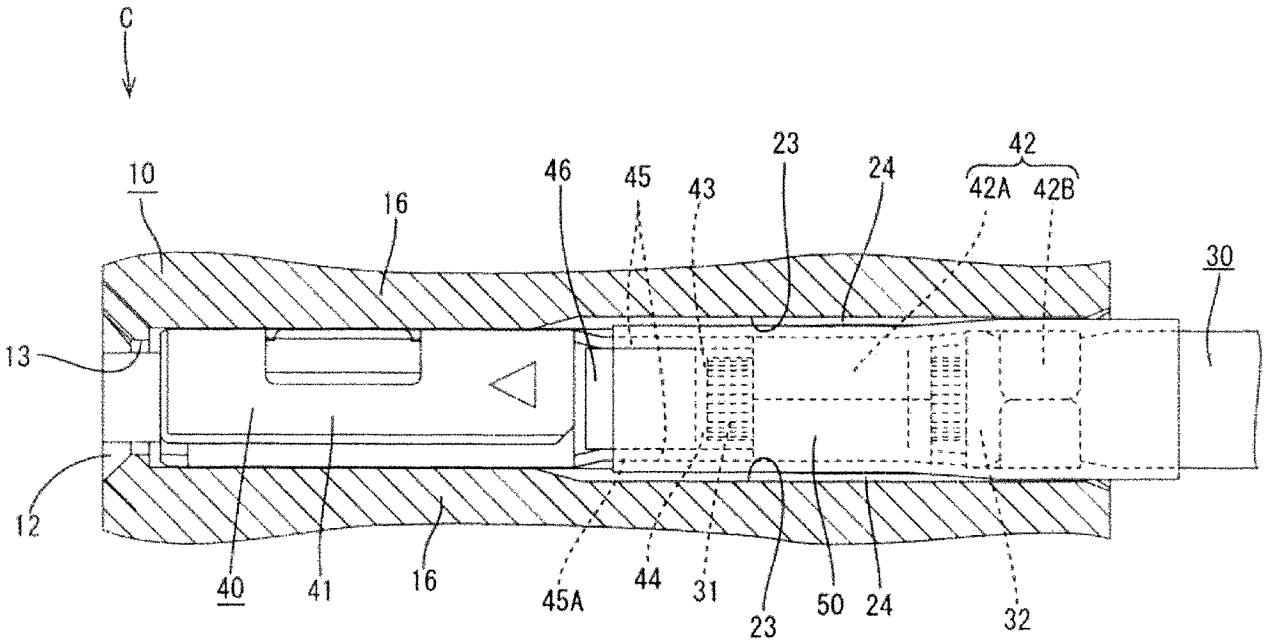
FIG. 5 is an enlarged plan view partly in section of the connector showing the state where the terminal fitting is accommodated in the cavity.

The barrel 42 is bent so that the insulation barrel 42B projects out or down. Specifically, as shown in FIG. 4, the base plate 44 of the barrel 42 is bent between the insulation barrel 42B and the wire barrel 42A so that the upper ends of the insulation barrel 42B and the fluid- or waterproof portion 46 are at substantially the same height. Thus, the bottom plate 44 of the insulation barrel 42B is at a position slightly lower or radially displaced than the bottom plate 44 of the wire barrel 42A.

A contact part between the barrel 42 and the core 31 of the wire 30 is covered by a waterproof member, preferably a heat shrinking tube 50. The heat shrinking tube 50 is made e.g. of a synthetic resin that shrinks when subjected to a heating treatment and has a tubular shape capable of covering from the link 43 of the terminal fitting 40 to the end portion of the insulation coating 32 of the wire 30 to a position behind the insulation barrel 42B. An adhesive layer (not shown) made e.g. of a thermoplastic adhesive which exhibits an adhesive property by being softened or melted by heat is provided on the inner peripheral surface of the heat shrinking tube 50.

The heat shrinking tube 50 is arranged to cover the contact part between the wire 30 and the terminal fitting 40 in an unheated state after the terminal fitting 40 is fixed to the end portion of the wire 30. Thereafter, the heat shrinking tube 50 shrinks by being irradiated or heated by an unillustrated heating apparatus and the adhesive on the inner peripheral surface thereof is melted to tightly adhere to the outer peripheral surface of the connected part between the terminal fitting 40 and the wire 30.

In the state covered by the heat shrinking tube 50, a rear part of the terminal fitting 40, excluding the connecting portion 41, is slightly larger than the parts not provided with an anti-corrosion measure. At the position of the fluid- or waterproof portion 46, the width is largest at boundaries between the outer peripheral surfaces of the waterproof portion 46 and the link 43 (end surfaces 45A of the side plates 45 of the link 43), as shown in FIG. 6. Thus, the width is larger in a lateral direction LD than in a vertical direction VD at the fluid- or waterproof portion 46.

Cavities 11 are provided substantially side by side in the housing 10 and the terminal fittings 40 can be inserted into the cavities 11 from behind. An arrangement pitch between the cavities 11 is the same as that of cavities of a connector compatible with conventional terminal fittings with no anti-corrosion measure so that the connection to the existing mating connector is possible.

A front part of the cavity 11 has a width in the lateral direction that conforms to the width of the connecting portion 41 in the lateral direction LD and an appropriate clearance.

The cavity 11 has a front wall 12 that stops forward movement of the terminal fitting 40 inserted into the cavity 11 (see FIG. 4). This front wall 12 has a tab insertion hole 13 for receiving the tab of the mating terminal fitting inserted from the front. Further, a mold removal hole 14 is formed in a part of the front wall 12 below the tab insertion hole 13 and enables forward removal of a front mold for forming a locking lance 19.

Figure 2:
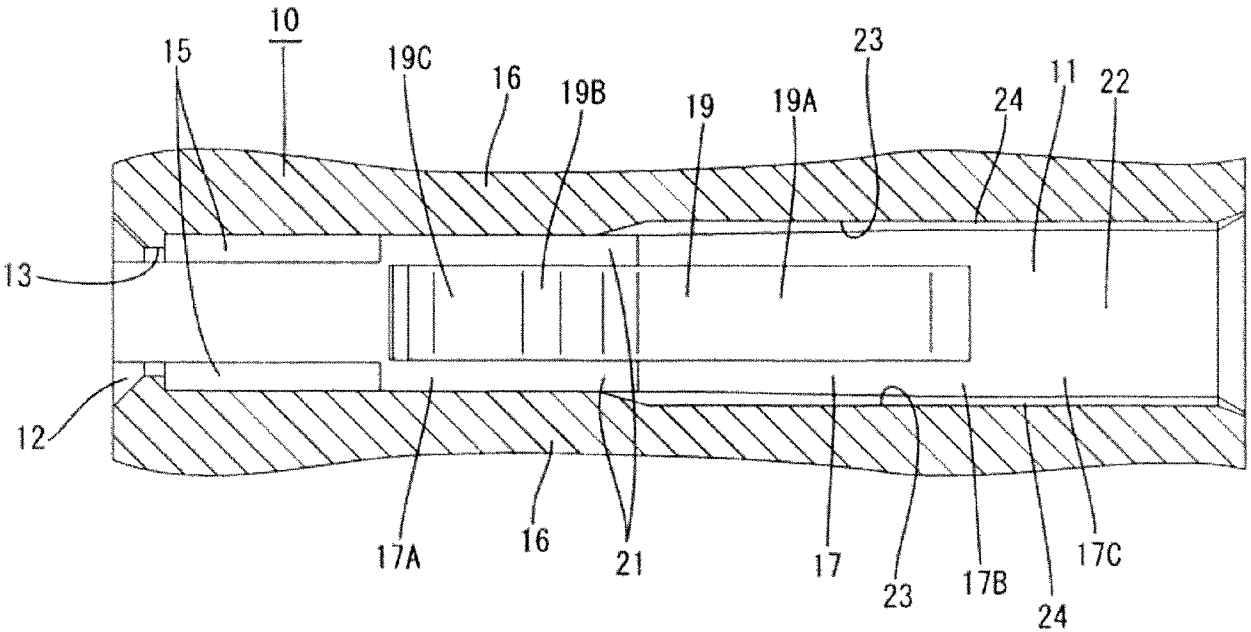
FIG. 2 is an enlarged plan view partly in section of the housing showing the shape of the cavity.
Figure 3:
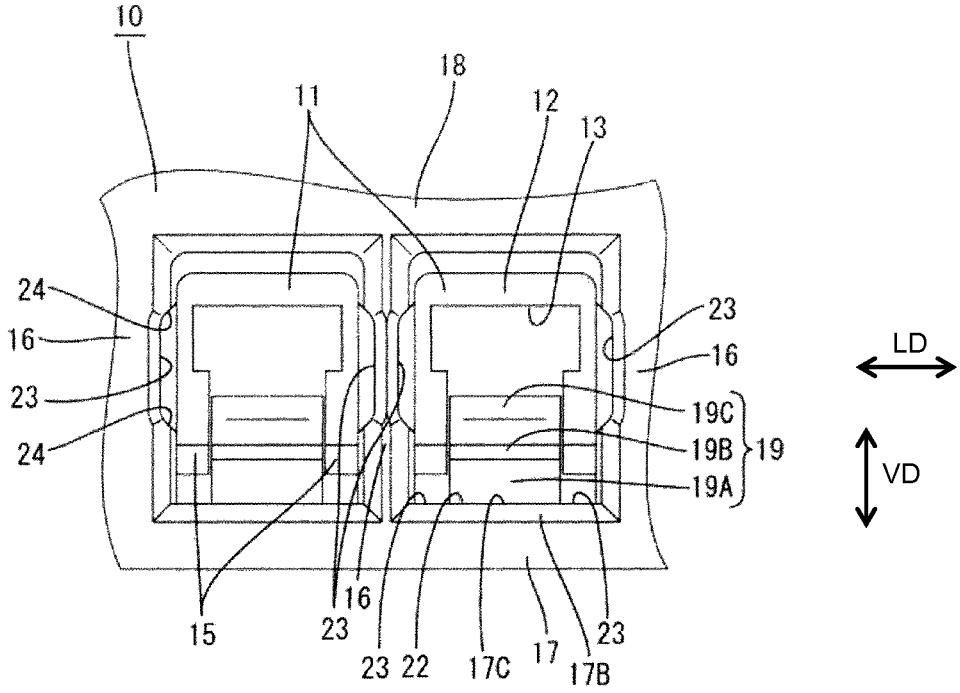
FIG. 3 is a partial enlarged rear view of the housing showing the shape of the cavity.

Supports 15 project in at both corners of the front end of the cavity 11 for supporting the front end of the connecting portion 41 of the terminal fitting 40 and to restrict inclination of the terminal fitting 40 in the vertical direction VD (resilient deforming direction of the locking lance 19). The supports 15 are connected to both the front wall 12 of the cavity 11 and a side wall 16 of the cavity 11, as shown in FIG. 2, to increase strength. A distance between the supports 15 and an upper wall 18 of the cavity 11 conforms to the width of the connecting portion 41 in the vertical direction (see FIG. 4).

A front part of a lower wall 17 of each cavity 11 is slightly lower than a rear part thereof. The front part of the lower wall 17 is referred to hereinafter as a lower portion 17A and the rear part is referred to as a higher portion 17B. A front part of the upper wall 18 of each cavity 11 is substantially parallel to the lower portion 17A of the lower wall 17, an intermediate part is inclined to slightly widen the width of the cavity 11 in the vertical direction toward the back, and a rear part is substantially parallel to the higher portion 17B.

The lower wall 17 of the cavity 11 has the locking lance 19 for locking and retaining the terminal fitting 40. The locking lance 19 projects in from an inner surface 17C of the lower wall 17 of the cavity 11.

The locking lance 19 has a base 19A that is formed unitarily to the higher portion 17B and is located above the higher portion 17B. A resilient displacing portion 19B is cantilevered forward from the base 19A and is above the lower portion 17A.

The thickness of the base 19A in the vertical direction VD is substantially constant, but the rear end surface of the base 19A is inclined gradually down toward the back.

The resilient displacing portion 19B is inclined gradually in or up toward the front to project into the cavity 11. A lock 19C projects into an insertion path for the terminal fitting 40 and is pressed by the connecting portion 41 of the terminal fitting 40 to deform the resilient displacing portion 19B out or down in a direction crossing inserting and withdrawing directions of the terminal fitting 40 with the base 19A as a supporting point. The resilient displacing portion 19B is retracted into a deformation space S between itself and the lower wall 17 of the lower portion 17A during this resilient deformation.

As shown in FIG. 2, the locking lance 19 is substantially in the widthwise center of the lower wall 17 and has a constant width over the entire length. Grooves 21 are formed at the opposite sides of the locking lance 19. The grooves 21 are surrounded by the locking lance 19, the lower wall 17 and the side walls 16. Stabilizers 47 can be inserted into the grooves 21 for guiding insertion of the terminal fitting 40.

A part of the lower wall 17 corresponding to the insulation barrel 42B is formed with at least one escaping portion 22 for increasing the width of the cavity 11 along the vertical direction VD (see FIG. 4). The escaping portion 22 is located outside of the insulation barrel 42B and prevents the insulation barrel 42B contacting the lower or upper wall 17 or 18 of the cavity 11 in a way that would hinder the insertion of the terminal fitting 40. The escaping portion 22 is a recess behind the locking lance 19 and is recessed to be lower than the base portion 19A of the locking lance 19, and a recessed dimension thereof is equal to the height of the base portion 19A. The inner surface 17C of the higher portion 17B is a flat surface except at the base portion 19A of the locking lance 19 and extends continuously from the escaping portion 22 to the grooves 21 without forming a step.

Figure 7:
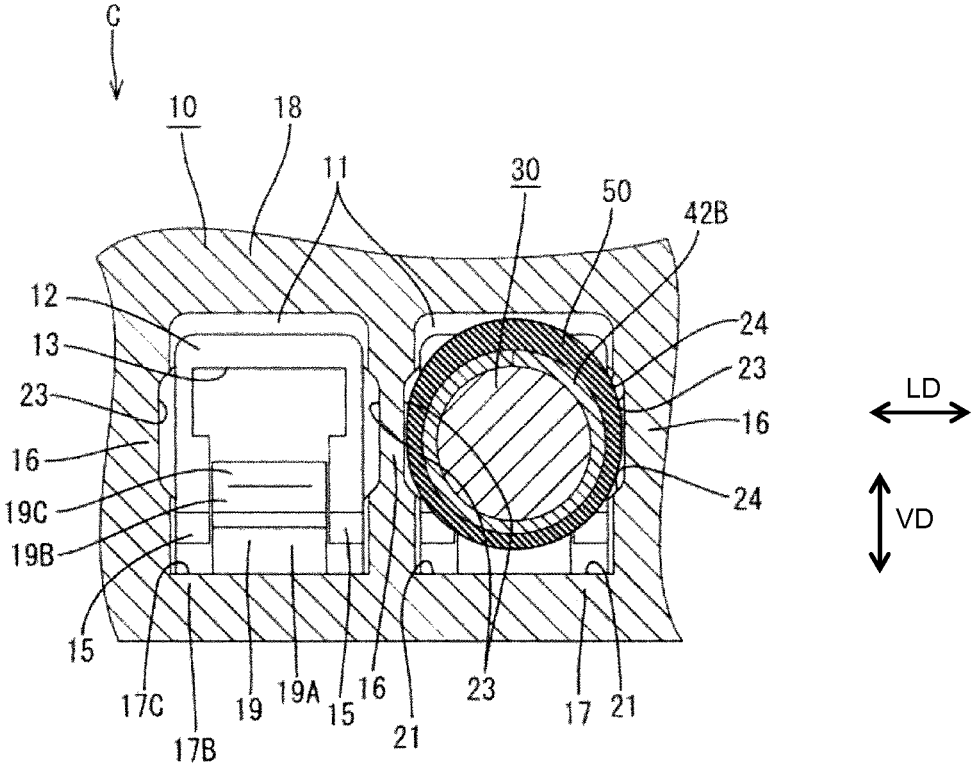
FIG. 7 is a partial enlarged lateral section along B-B of FIG. 4 of the connector showing the state where the terminal fitting is accommodated in the cavity.

Recesses 23 are formed in parts of the side walls 16 of the cavity 11 corresponding to the barrel 42 of the terminal fitting 40 for widening the cavity 11 in the lateral direction LD so that these parts are dented with respect to other parts (see FIGS. 6 and 7). As shown in FIG. 1, the recess 23 is long and narrow in forward and backward directions when viewed sideways and is formed in a range from a position slightly before the fluid- or waterproof portion 46 to the rear end of the cavity 11. The dimension of the recess 23 in a vertical direction VD is substantially constant in its entirety and the end surface 45A of the side plate 45 of the link 43 is located in the center thereof in the vertical direction VD, as shown in FIG. 6. Note that the recesses 23 are formed on the opposite side surfaces of the side wall 16 partitioning between the adjacent cavities 11.

As shown in FIG. 2, front parts of the side walls 16 of the cavity 11 connected to the lower portion 17A of the lower wall 17 are substantially parallel to each other and rear parts connected to the higher portion 17B of the lower wall 17 are inclined slightly to increase the lateral width of the cavity 11 toward the back. In this way, the depth of the recesses 23 is reduced gradually toward the back. Note that front end parts of the recesses 23 are inclined to gradually reduce the depth toward the front.

The recesses 23 are shaped to conform to the outer shape of the barrel 42. Specifically, the cross-sectional shape of the barrel 42 is substantially circular and the outer shape of the heat shrinking tube 50 mounted on the terminal fitting 40 also is substantially circular. Thus, inclined surfaces 24 are provided on the upper and lower ends of the recesses 23 to conform to the outer shape of the heat shrinking tube 50 mounted on the terminal fitting 40 (see FIG. 7). The upper and lower inclined surfaces 24 are oblique so that a distance therebetween gradually increases toward the inside of the cavity 11.

The terminal fitting 40 is inserted into the cavity 11 from behind so that the connecting portion 41 is inserted into the cavity 11 first and then the fluid- or waterproof portion 46 is inserted into the cavity 11. The recesses 23 formed in the side walls 16 of the cavity 11 enable the fluid- or waterproof portion 46 to be inserted smoothly forward without the opposite side surfaces thereof being pressed against the side walls 16.

The wire barrel 42A and the insulation barrel 42B then are inserted into the cavity 11. The cavity 11 has a sufficient clearance for the wire barrel 42A so that the wire barrel 42A moves smoothly forward.

The recesses 23 in the side walls 16 of the cavity 11 ensure that the insulation barrel 42B moves smoothly forward without the opposite side surfaces thereof being pressed against the side walls 16. Further, the downward projecting insulation barrel 42B is arranged in the escaping portion 22 so that the insulation barrel 42B is inserted smoothly into the cavity 11 and is accommodated in a rear end part of the cavity 11 without the lower or upper ends thereof being pressed strongly against the lower and upper walls 17 and 18 of the cavity 11.

The terminal fitting 40 then is inserted to a proper depth in the cavity 11 so that the locking lance 19 that has been deformed into the deformation space S by the connecting portion 41 of the terminal fitting 40 is restored resiliently. Thus, the locking portion 19C engages an engaging portion 48 of the connecting portion 41 to retain the terminal fitting 40.

The housing 10 has the cavities 11 and the terminal fittings 40 fixed to the ends of the wires 30 can be inserted from behind into the cavities 11. Each terminal fitting 40 has the barrel 42 to be fixed to the core 31 of the wire 30. The contact part between the barrel 42 and the core 31 of the wire 30 is covered by the heat shrinking tube 50. Parts of the side walls 16 of each cavity 11 corresponding to the barrel 42 of the terminal fitting 40 are formed with the recesses 23 for widening the cavity 11 in the lateral direction LD (i.e. the arrangement direction of adjacent cavities 11).

The clearance allows the insertion of the part of the terminal fitting 40 that is covered by the heat shrinking tube 50 or other fluid-proof member to be inserted. Further, the cavity 11 is widened in the lateral direction LD by forming the recesses 23 in the side walls 16 of the cavity 11 and without enlarging the connector C. Furthermore, the recesses 23 are formed only in the parts of the side walls 16 of the cavity 11 corresponding to the barrel 42 of the terminal fitting 40. Thus, a short circuit between the terminal fittings 40 is not likely and resin fluidity in molding the housing 10 is not impaired. Accordingly, the terminal fittings 40 with the anti-corrosion measure can be inserted without causing short circuits between the terminal fittings 40, without deteriorating resin fluidity when molding the housing 10 and without making the connector C larger than conventional connectors C.

Each recess 23 has the inclined surfaces 24 in conformity with the outer shape of the heat shrinking tube 50 to suppress the size of the recess 23 to a minimum.

The invention is not limited to the above described embodiment. For example, the following embodiments also are included in the scope of the invention.

The female connector C in which the female terminal fittings 40 are inserted in the housing 10 is illustrated in the above embodiment. However, the invention is applicable to male connectors with male terminal fittings inserted in a housing.

The core 31 of the wire 30 is made of aluminum or aluminum alloy and the terminal fitting 40 is made of copper or copper alloy in the above embodiment. However, there is no limitation to this and the core of the wire and the terminal fitting may be made of other metals as needed. Even if the core of the wire and the terminal fitting are made of the same metal, the invention can be applied if the outer shape becomes one size larger by waterproofing the connected part between them.

Although the waterproof portion 46 is formed by fitting the resin processed material into the groove of the link 43 and applying a heating treatment. However, there is no limitation to this. For example, the waterproof portion may be formed by molding a synthetic resin or the waterproof portion may not be provided. In the case of providing no waterproof portion, the formation range of the recesses can be made smaller and the recesses may be formed only in parts corresponding to the insulation barrel.

Although the fluid- or waterproof member is the heat shrinking tube 50 in the above embodiment, there is no limitation to this and the fluid- or waterproof member may be an elastic tube having rubber elasticity. Further, a sheet-like fluid- or waterproof tape may be wound in an area from the waterproof portion to the end portion of the insulation coating or a resin mold or the like may be mounted.

The depth of the recess 23 is reduced gradually toward the back in the above embodiment. However, the depth of the recess may be substantially constant in its entirety or may be increased gradually toward the back.

The recesses 23 are provided in the both side walls 16 of the cavity 11 in the above embodiment. However, the recess may be provided in the upper or lower wall of the cavity or may be provided in only one of the both side walls of the cavity depending on the shapes and the like of the barrel and the waterproof member.

What is claimed is:

1. A connector, comprising:

at least one terminal fitting including a barrel having a wire barrel fixed to a core of a wire and an insulation barrel fixed to an insulation coating of the wire;

a fluidproof member covering at least the barrel; and a housing having opposite front and rear ends and including at least one cavity extending between the front and rear ends for receiving the terminal fitting fixed to the wire, the at least one cavity having a lower wall, an upper wall and first and second side walls extending between the lower wall and the upper wall, first and second recesses formed respectively in a parts of the first and second side walls of the cavity spaced from the upper and lower walls and extending from the rear end of the housing toward the front end for widening the cavity and accommodating lateral parts of the fluidproof member covering the barrel.

2. The connector of claim 1, wherein the recess includes at least one inclined surface substantially in conformity with an outer shape of the fluidproof member.

3. The connector of claim 1, wherein the fluidproof member comprises a heat shrinking tube.

4. The connector of claim 1, wherein the terminal fitting includes a connecting portion to be connected to a mating terminal fitting and a link linking the barrel and the connecting portion, the fluidproof member also covering at least part of an outer side of the link.

5. The connector of claim 4, wherein the link includes a fluidproof portion at least partly filling a clearance between the link and the fluidproof member.

6. The connector of claim 5, wherein the recess is formed in a part corresponding to the fluidproof portion.

7. The connector of claim 5, wherein the link comprises a base plate and two side plates and wherein the fluidproof portion at least partly fills a portion of the link enclosed by the base plate and the side plates.

8. The connector of claim 4, wherein the barrel has barrel pieces for at least partly surrounding and engaging the core of the wire from an outer side while the projecting edges of the barrel pieces are butted against each other.

9. The connector of claim 8, wherein the barrel is bent so that the insulation barrel projects outwardly, a base plate of the barrel is bent between the insulation barrel and the wire barrel so that upper ends of the insulation barrel and the fluidproof portion are substantially at a common height.

10. The connector of claim 9, wherein the recess has a substantially constant dimension in a vertical direction and an end surface of a side plate of the link is substantially centered in the recess in the vertical direction.

11. The connector of claim 10 wherein the insulation barrel has a lower wall offset lower than the wire barrel, and wherein a part of a base wall of the cavity corresponding to the insulation barrel has at least one escaping portion for increasing a dimension of the cavity in a vertical direction and preventing the insulation barrel from contacting the lower wall of the cavity in a way that would hinder insertion of the terminal fitting.

12. The connector of claim 1, further comprising at least one support projecting in at a front end of the cavity for supporting a front end of a connecting portion of the terminal fitting to restrict inclination of the terminal fitting in a resilient deforming direction of a locking lance, wherein the support is connected to both a front wall of the cavity and a side wall of the cavity.

13. The connector of claim 1, wherein upper and lower inclined surfaces are provided on upper and lower ends of each of the recesses to substantially conform to an outer shape of the fluidproof member mounted on the terminal fitting, the inclined surfaces being aligned so that a distance therebetween gradually increases toward positions further toward a center of the cavity.

14. The connector of claim 1, wherein a depth of the recess is reduced gradually toward the rear end of the housing and a front end part of the recess is inclined to gradually reduce the depth toward the front.

* * * * *